US006685465B2

(12) United States Patent
Marquardt

(10) Patent No.: US 6,685,465 B2
(45) Date of Patent: Feb. 3, 2004

(54) DRUM HEATER WITH HOT GAS CONDUIT SEGMENTS, IN PARTICULAR FOR ASPHALT RECYCLING

(76) Inventor: Dieter Marquardt, Achtern Busch 4, Weddelbrook (DE), D-24576

( * ) Notice: Subject to any disclaimer, the term of this patent is extended or adjusted under 35 U.S.C. 154(b) by 0 days.

(21) Appl. No.: 10/196,720

(22) Filed: Jul. 16, 2002

(65) Prior Publication Data

US 2003/0211438 A1 Nov. 13, 2003

(30) Foreign Application Priority Data

May 7, 2002 (DE) ..... 202 07 214 U

(51) Int. Cl.[7] ..... F27B 7/18

(52) U.S. Cl. ..... 432/108; 432/111; 432/118; 366/25

(58) Field of Search ..... 432/103, 105, 432/108, 109, 111, 118; 366/24, 25; 34/201, 203, 208

(56) References Cited

U.S. PATENT DOCUMENTS

| | | | | | |
|---|---|---|---|---|---|
| 4,260,373 | A | * | 4/1981 | Fellnor et al. | 432/110 |
| 5,083,870 | A | | 1/1992 | Sindelar et al. | |
| 5,282,695 | A | * | 2/1994 | Crosby et al. | 405/128.85 |
| 5,295,821 | A | * | 3/1994 | Daukss | 432/103 |
| 5,658,094 | A | * | 8/1997 | Clawson | 405/128.85 |
| 6,340,240 | B1 | * | 1/2002 | Swisher et al. | 366/25 |

* cited by examiner

*Primary Examiner*—Gregory Wilson
(74) *Attorney, Agent, or Firm*—Hedman & Costigan, P.C.

(57) ABSTRACT

A rotary drum heater for mixing asphalt with a hot gas introduced into the drum by gas burners is disclosed. The drum has an inlet opening for material to enter the drum to be processed and an outlet opening for material to exit. The hot gas is blown into the interior of the drum and is diverted by a hot gas conduit segment that is designed to gently heat the asphalt.

13 Claims, 3 Drawing Sheets

DRUM HEATER WITH HOT GAS CONDUIT SEGMENTS, IN PARTICULAR FOR ASPHALT RECYCLING

FIELD OF THE INVENTION

The present invention relates to a drum heater with rotary drum and hot gas burner for blowing hot gases into the rotary drum interior fitted with at least one hot gas conduit segment, in particular for asphalt recycling.

BACKGROUND OF THE INVENTION

Asphalt road surfaces are manufactured with minerals being heated in a drying drum and then mixed in another mixing drum with hot bitumen and with the mixture then heated to a temperature of approximately 150° C. With the temperature of 120° C. to 180° C. required for making asphalt road surfaces the asphalt is a viscous liquid product, whereby the bitumen constituents encase the minerals and bond into a solid mass after cooling to form a viscous, wear-resistant road surface.

Asphalt is understood in this invention to mean road asphalt having a lesser bitumen proportion of approximately less than 5% by weight.

If, however, the asphalt is subjected to high temperatures during the heating procedure, such as e.g. a direct flame, the asphalt then carbonises. This coking of the asphalt is undesired, as this releases smoke and contaminated waste gases and the binding capacity of the asphalt is reduced. For the purposes of rapid heating of large quantities of road surface asphalt compositions high temperatures must be applied to cause rapid heating of the asphalt mixture.

The drum heater according to the present invention is also suited to the additional task of drying and heating of other granular materials. Applying indirect hot gas heating on the one hand guarantees rapid and economical readiness and on the other hand enables environmentally friendly treatment; without material combustion gases or cracked gases being released. Indirect heating makes it possible to avoid excess temperatures and material combustion in the material to be recycled/treated.

The asphalt to be prepared and fed to the rotary drum comprises a bituminous mixture comminuted into different lump sizes by mechanical crushing or pulverizing plants. The material to be prepared is generally 40×40 centimeters in size, e.g. with an asphalt cover thickness of up to 10 centimeters.

Drum heaters with blowpipe burner, oil or gas flame heating are known for heating asphalt recycling granulate. Diverse configurations of such drum heaters are known from the prior art, which have cylindrical rotary drums. Arranged fixed on a front face of the cylindrical rotary drum, approximately at the level of the axis of rotation, is a burner with a hot gas flame directed into the interior of the rotary drum. The other rotary drum end is fitted with a delivery opening, via which the hot gas flows out and at the same time preheats or dries the asphalt lumps to be supplied for comminution. The comminuted or molten asphalt leaves the rotary drum in the vicinity of the rotary drum end on which the hot gas burner is arranged.

With conventional rotary drum heaters the burner heat is often not fully utilised, because the insufflated hot gases exit from the rotary drum interior too quickly. The exit of the hot gases is often hindered only slightly by the introduced asphalt lumps to be processed and these lumps can be impacted directly by the burner flame.

In the prior art various solutions have already been proposed for better utilisation of burner heat. U.S. Pat. No. 5,083,870-A, for its German equivalent DE 42 00 760-C2, for example, describe a road asphalting machine for making an asphalt surface, having a rotatable cylindrical mixing drum, divided into two chambers by a partition extending through the rotary drum. The material fed to the rotary drum for heating is prewarmed in the fore section of the heating chamber and latent heat is recovered from the water vapour in the heating chamber exhaust. The second chamber has a plurality of burners arranged beneath the rotary drum and aligning with the rotary drum axis. Each heater is partially separated by zone separation plates from the adjoining heaters. The heaters are swivel-mounted on a frame, on which the heating chamber and the rotary drum are arranged and can be rotated to change the angle at which the burner flame affects the rotary drum. Quadrant plates subdivide the rotary drum along its axis to form four identical rotary drum quadrants. The quadrant plates have through-slots for material to pass through from one quadrant to another. The material in the rotary drum is heated in countercurrent by the combustion gases from the burners in the heating section of the chamber.

SUMMARY OF THE INVENTION

It is the object of the present invention to provide a rotary drum of the type initially outlined, which better utilizes the heat of the introduced hot gases and avoids direct contact of the asphalt lumps with the burner flame and at the same time enables the simplest possible rotary drum interior. The aim is to enable gentle heating and intermixing of the asphalt break-up and/or if required other granular materials to be prepared, in which the bituminous mixture is subjected to a minimal grinding effect only with the most even and extensive indirect heating possible.

It was surprisingly ascertained that this task is solved according to the present invention in that arranged inside the rotary drum interior is a unipart or multipart hot gas conduit segment which has at least one hot gas surface of impingement which extends from the rotary drum inner wall to the rotary drum interior and is aligned in the direction of the hot gas flow. The hot gas is insufflaled preferably substantially parallel to the longitudinal axis of rotation of the rotary drum. The invention is characterised by claim 1. Preferred Embodiments are the subject of the sub-claims.

DETAILED DESCRIPTION OF THE INVENTION

Figure 1:
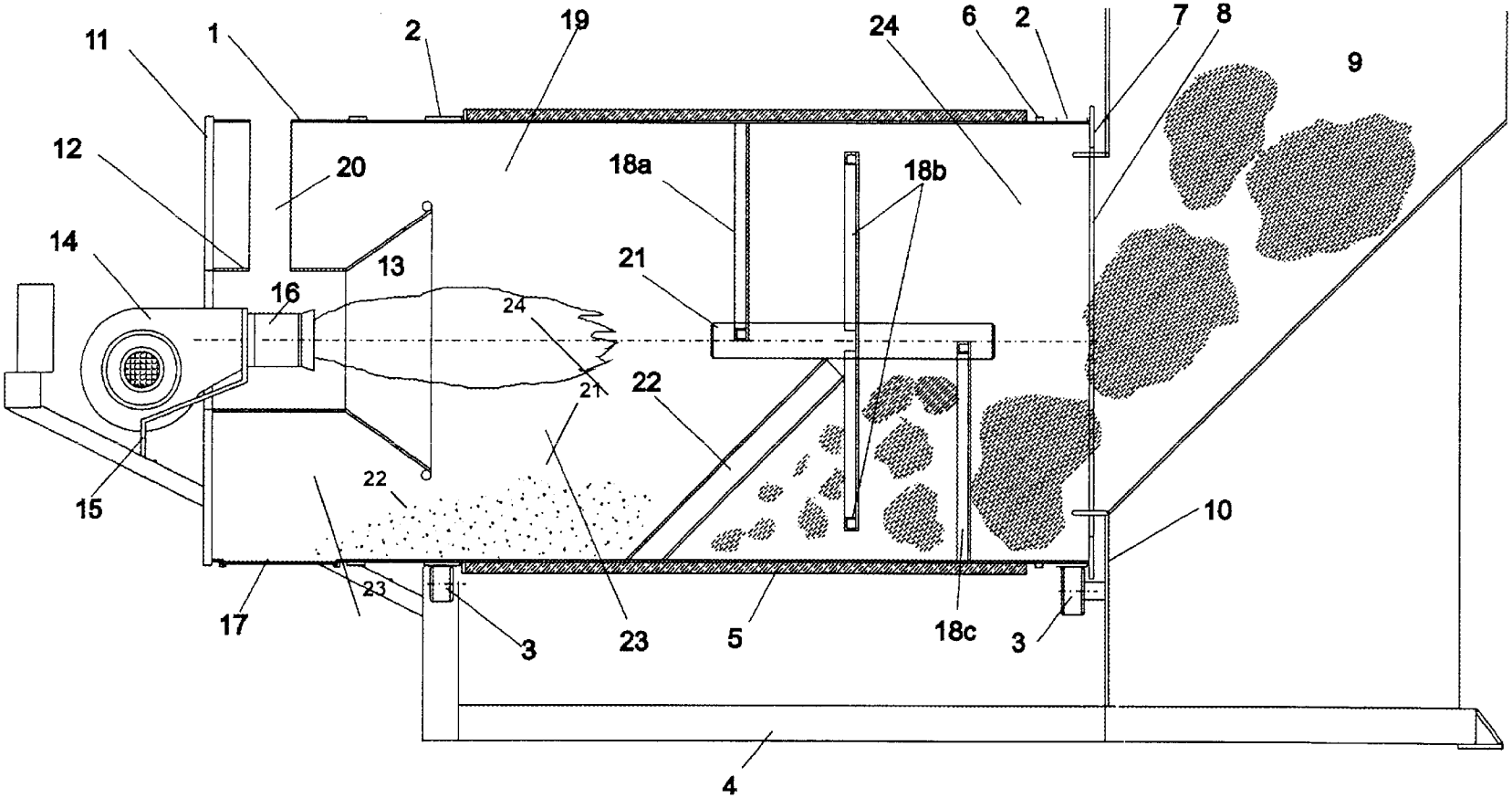
FIG. 1 illustrates a longitudinal cross sectional view of an embodiment of the present invention.

The rotary drum preferably has a substantially cylindrical shape and is operated in countercurrent, that is, a preferably fixed hot gas burner with a hot gas flame directed into the interior of the rotary drum is located on one side of the essentially circular front wall, preferably approximately level with the axis of rotation of the rotary drum. The hot gas flame is preferably aligned substantially parallel to the axis of rotation. The opposite side of the rotary drum has a delivery opening, to which is attached a device for material supply, preferably in the form of a funnel-shaped chute.

The hot gas flows from the hot gas burner substantially parallel to the axis of rotation of the rotary drum to the delivery opening and flows out via the material supply, at the same time warming the lumps to be fed to the rotary drum. The warmed material, e.g. the comminuted or partly molten asphalt leaves the rotary drum in the vicinity of the rotary drum end facing the hot gas burner via one or more preferably lockable openings in the rotary drum wall.

For effective intermixing and feeding, the rotary drum is arranged substantially horizontally when in operation. Lowering the rotary drum end allows the rotary drum to be dislocated into a certain inclined position, whereby the dwell time of the bituminous mixture in the rotary drum is regulated. As long as the rotary drum is mounted on a vehicle chassis this can be done most simply by lowering the vehicle chassis on one side.

The material can be supplied via a simple funnel-shaped chute, but also via conveyor belts or Screw conveyor, whereby it should be ensured advantageously that the hot gases leaving the rotary drum contact the feed material and prewarm at.

Due to the arrangement of the hot gas conduit segments acting as heat damming and conduit segments in the rotary drum interior the heat is better diverted, distributed and stowed in the rotary drum interior, so that the outer reaches of the rotary drum interior are better supplied with heat, without the material lumps preferably retained there coming into direct contact with the burner flame. This contributes to improved utilisation of heat.

According to another embodiment of the invention the hot gas surfaces of impingement are distributed in the longitudinal direction of the rotary drum such that, in the plan view along the axis of rotation of the rotary drum, they fill out the diameter interface of the rotary drum to at least 80%, preferably to at least 95% of the rotary drum, more preferably completely. In this way the hot gases must negotiate a type of labyrinth/spiral in the rotary drum interior, before they reach the outlet.

According to another embodiment of the invention the hot gas surfaces of impingement take the form of partly circular sections, that is, the shape of sections of pie, which are arranged offset to one another in the longitudinal direction of the rotary drum, subdivide the rotary drum into different segments, at least half-open to one another, and are arranged substantially vertically to the rotary drum axis of rotation. A particularly advantageous arrangement is one which is characterised in that the hot gas surfaces of impingement are designed as quarter to third circular surfaces which are arranged mutually and evenly offset in a constant offset direction and degree of angle. Apart from the hot gas diversion in the rotary drum interior the dwell time of the asphalt lumps between the individual segments can also be controlled. While these segments are passing through, the asphalt lumps absorb the heat also from the hot gas surfaces of impingement and break down into smaller particle sizes. The resulting asphalt granulate flows through the rotary drum interior substantially in the lower region of the rotary drum untouched by the burner flame. The bituminous mixture reaches the required asphalt insertion temperature by heat emission from the heated rotary drum walls and via contact with the deflected hot gas, but without direct contact from the burner flame.

The hot gas burner generating hot gas is generally an oil or gas burner. Connected to the hot gas burner is the combustion chamber which is enclosed on the outside by a covering, whereby the secondary mixed air is fed into the space between combustion chamber and covering. The hot gases and the secondary mixed air meet at the mixing nozzle and from here are introduced into the hot mixing conveyor via a rotating joint with inbuilt linear compensator. The device generating hot gas is arranged fixed, while the rotary drum revolves. Connection is made by the rotating joint which is protected from hot gases by the secondary mixed air. The compensator serves to take up linear extension of the rotary drum during operation. The temperature in the rotary drum interior is controlled by one or more, preferably one, temperature sensor, which regulates the hot gas burner output.

The continuously accumulating asphalt granulate is also still free-flowing after the final temperature of ca. 130 to 170° C. is reached. Due to heating with a hot gas in countercurrent flowing through the rotary drum the old bituminous mixture is heated gently.

DESCRIPTION OF THE PREFERRED EMBODIMENTS

Figure 2:
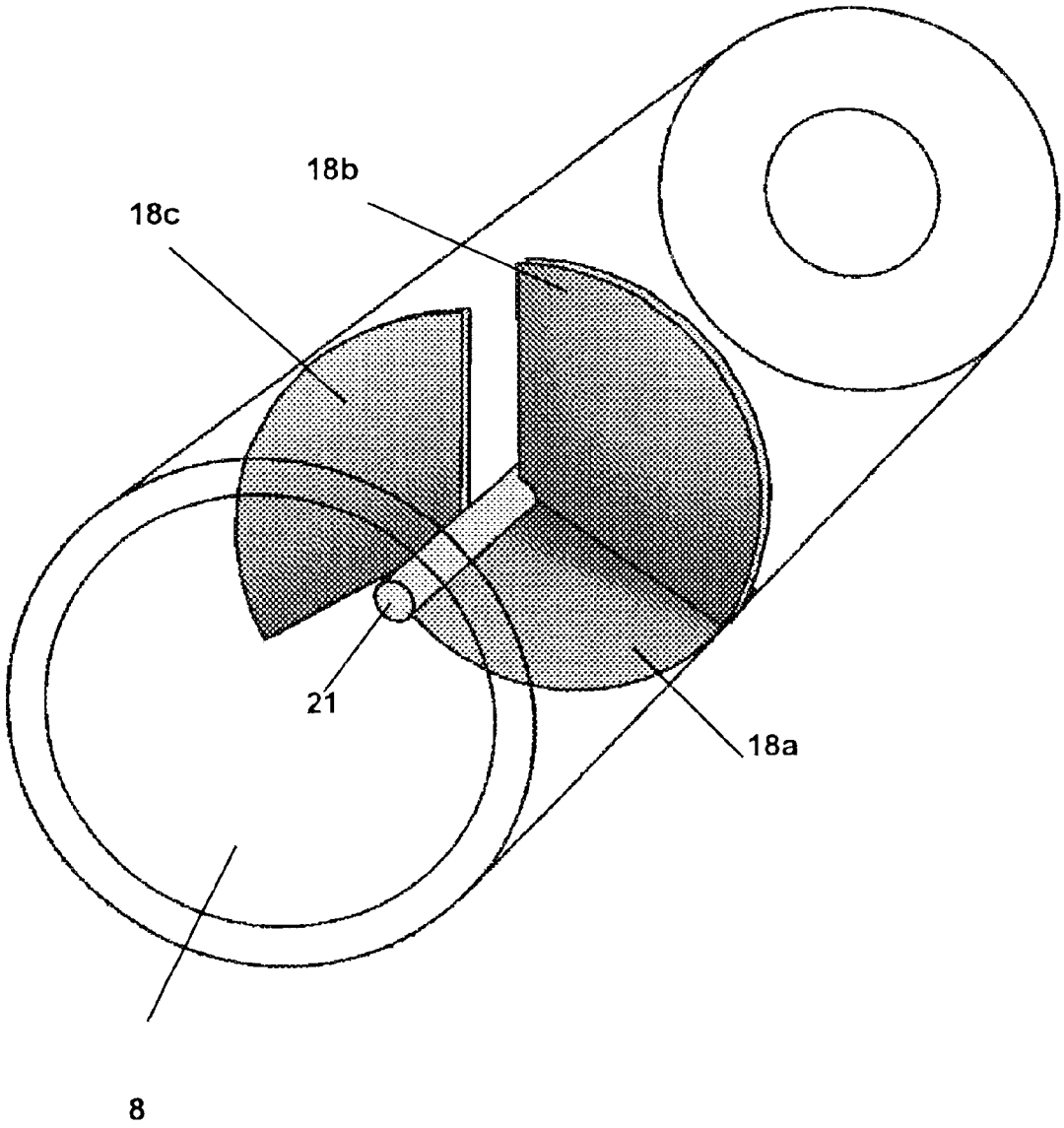
FIG. 2 illustrates a cross sectional view through an embodiment of a rotary drum of the present invention.
Figure 3:
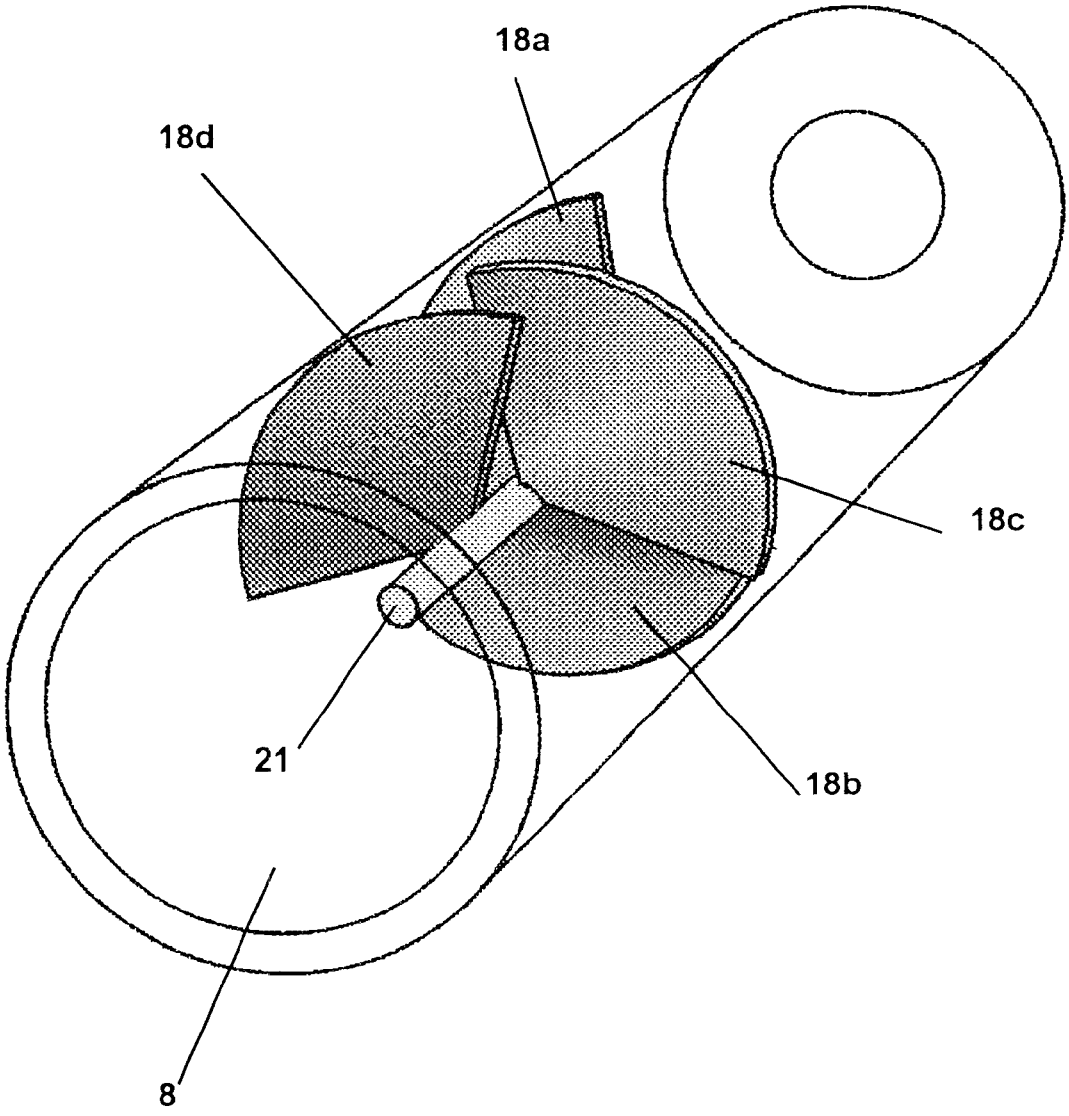
FIG. 3 illustrates another cross sectional view through an embodiment of a rotary drum of the present invention.

The invention is now explained in greater detail by way of FIGS. 1 to 3. Light oil burner (14) is attached to the vehicle frame (4) via a bracket (15). Located in the centre of the hot gas outlet casing (12) is the burner pipe (16) with nozzles, not illustrated here. Located in the vicinity of the separating pipe also is a closable outlet opening (17) for the prepared asphalt material.

FIG. 2 illustrates a section through the rotary drum (1) with three hot gas surfaces of impingement **(18*a*, 18*b*, 18*c*) which extend as sector of a circle surfaces substantially 120° from the rotary drum inner wall to the centre of the rotary drum and which are aligned vertically to the rotary drum axis of rotation, whereby they are successively arranged offset to the brace (21) at identical intervals. No further details are illustrated in FIG. 2**.

FIG. 3 illustrates via another section through the rotary drum a preferred embodiment with four hot gas surfaces of impingement **(18*a*, 18*b*, 18*c*, 18*d*), which are designed as 120° sector of a circle surfaces and which extend from the rotary drum inner wall to the centre of the rotary drum, with the surfaces of impingement aligned vertically to the rotary drum axis of rotation. In the centre of the rotary drum the, four sector of a circle surfaces are fixed by a tubular brace (21). The hot gas surfaces of impingement are arranged successively on the brace (21) at identical intervals and are also arranged on the periphery of the brace such that with respect to the inner circular surface of the rotary drum the former cover the latter, such that in the plan view along the rotary drum axis four overlapping surfaces each of 30° are formed, No further details are illustrated in FIG. 3**.

FIG. 1 illustrates a rotary drum (1), rotating about its linear axis, of an asphalt recycler mounted on a vehicle frame (4) with a hot gas burner device (14, 16 from which hot gases can blow into the rotary drum interior (19) via the hot gas burner nozzles. The mixing drum (1) is fitted with supply (8) and outlet openings (17) for the asphalt material to be processed in the vicinity of the rotary drum ends (7, 11). The hot gas burner device (14, 16) is directed at the delivery drum end (7) from the rotary drum end (11), which lies opposite the delivery drum end (7) (same as rotary drum inlet). The hot gas is diverted by the hot gas conduit segments (18) arranged offset in rotary drum linear direction, designed in the shape of three hot gas surfaces of impingement **(18*a*, 18*b* and 18*c*) aligned vertically to the rotary drum axis of rotation and having the shape of three-quarter sections offset to one another, The hot gas surfaces of impingement (18***a*, 18*b* and 18*c*) are each solidly attached on the rotary drum inner walls in an arc of a circle to the rotary drum, as well as attached jointly in the rotary drum centre to a brace (21). The brace (21) is additionally attached to the rotary drum wall by a cross brace (22).

The rotary drum pipe (1) rests on castors (3) with ball races (2) which are preferably swivel-mounted on the vehicle frame (4). The rotary drum wall is provided with heat insulation (5). The mixing drum is rotated via a drive ring with chain gearing (6) by a drive motor, not illustrated here.

Provided on one of the rotary drum ends (7) is a delivery opening (8), situated in front of which is a discharge funnel (9). The discharge funnel (9) is not rotatable, rather it is fixed in place on a casing (10), in turn connected to the vehicle frame (4). Located on the rotary drum end (11) is a retracted hot gas outlet casing (12), in whose cavity (13) is inserted a light oil burner (14). The

What is claimed is:

1. A drum heater having a rotary drum with a hot gas burner for insufflating hot gases into the rotary drum interior and delivery opening for the loose material to be processed at the rotary drum inlet and outlet opening in the vicinity of the rotary drum end, characterized in that the hot gas is blown in from the rotary drum end in the direction of the rotary drum inlet and is diverted by a unipart or multipart hot gas conduit segment which is designed as one or more hot gas surfaces of impingement mounted solidly and extending from the rotary drum inner wall to the rotary drum center, are aligned against the direction of the hot gas flow and in the plan view of the rotary drum interior along the rotary drum linear axis or axis of rotation they together fill out at least 80% of the rotary drum interface.

2. The drum heater as claimed in claim 1, characterized in that the first hot gas surface of impingement is arranged approximately level with greater than half, of the length of the rotary drum linear axis from the rotary drum end to the rotary drum inlet, and the rotary drum is divided into combustion chamber and supply chamber.

3. The drum heater according to claim 2 wherein the first hot gas surface of impingement is arranged with greater than 60% of the length of the rotary drum linear axis from the rotary drum end to the rotary drum inlet.

4. The drum heater according to claim 2 wherein said supply chamber is segmented by further hot gas surfaces of impingement.

5. The drum heater according to claim 1, characterized in that the hot gas surfaces of impingement have approximately the form of circular section surfaces which are arranged offset to one another in the rotary drum linear direction to divide the rotary drum in the vicinity of the supply space into several interconnected segments and are attached solidly to the rotary drum inner wall along the lower arc line of the circular section surface.

6. The drum heater according to claim 1, characterized in that the rotary drum has at least three hot gas surfaces of impingement.

7. The drum heater according to claim 1, characterized in that the hot gas surfaces of impingement are arranged such that they form an angle of 90°+/−10°, with the axis of rotation of the rotary drum.

8. The drum heater according to claim 7, wherein said angle is approximately 90°.

9. The drum heater according to claim 1, characterized in that the hot gas surfaces of impingement overlap in the plan view along the axis of rotation, whereby the overlapping surfaces, with respect to the plan view, comprise up to about 34% of the inner drum circular surface along the axis of rotation of the rotary drum.

10. The drum heater according to claim 9 wherein said overlapping surfaces, with respect to the plan view, comprise up to about 20% of the inner drum circular surface along the axis of rotation of the rotary drum.

11. The drum heater according to claim 10 wherein said overlapping surfaces, with respect to the plan view, comprise up to about 10% of the inner drum circular surface along the axis of rotation of the rotating drum.

12. The drum heater according to claim 1, characterized in that the hot gas outlet of the hot gas burner is disposed inside a hot gas outlet casing and the cavity formed by the hot gas outlet casing and hot gas burner is connected to the atmosphere by means of an overflow pipe.

13. The drum heater according to claim 1 wherein said one or more hot gas surfaces of impingement fill out the rotary drum interface at least completely.

* * * * *

UNITED STATES PATENT AND TRADEMARK OFFICE

CERTIFICATE OF CORRECTION

PATENT NO. : 6,685,465 B2
DATED : February 3, 2004
INVENTOR(S) : Dieter Marquardt It is certified that error appears in the above-identified patent and that said Letters Patent is hereby corrected as shown below:

Title page,
Insert Item -- [73] Assignee: Bagela Baumaschinen GmbH & Co. --.

Signed and Sealed this

Sixth Day of July, 2004

JON W. DUDAS
*Acting Director of the United States Patent and Trademark Office*